US006427767B1

(12) United States Patent
Mougin

(10) Patent No.: US 6,427,767 B1
(45) **Date of Patent: *Aug. 6, 2002**

(54) NUCLEATE BOILING SURFACE

(75) Inventor: Louis J. Mougin, La Crosse, WI (US)

(73) Assignee: American Standard International Inc., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/806,805

(22) Filed: Feb. 26, 1997

(51) Int. Cl.[7] ..... F28F 13/18
(52) U.S. Cl. ..... 165/133; 165/179; 165/181
(58) Field of Search ..... 165/179, 133, 165/181, 184

(56) References Cited

U.S. PATENT DOCUMENTS

| | | | | |
|---|---|---|---|---|
| 3,314,260 A | | 4/1967 | Habdas et al. | 72/56 |
| 3,326,283 A | | 6/1967 | Ware | 165/181 |
| 3,327,512 A | | 6/1967 | Novak et al. | 72/367 |
| 3,487,670 A | | 1/1970 | Ware | 72/108 |
| 3,598,180 A | | 8/1971 | Moore, Jr. | 165/133 |
| 3,600,922 A | | 8/1971 | Schmeling et al. | 72/98 |
| 3,602,027 A | | 8/1971 | Klug et al. | 72/98 |
| 3,648,502 A | | 3/1972 | Klug et al. | 72/78 |
| 3,683,656 A | | 8/1972 | Lewis | 72/98 |
| 3,696,861 A | | 10/1972 | Webb | 165/133 |
| 3,768,290 A | | 10/1973 | Zatell | 72/68 |
| 3,881,342 A | | 5/1975 | Thorne | 72/68 |
| 4,040,479 A | | 8/1977 | Campbell et al. | 165/133 |
| 4,059,147 A | | 11/1977 | Thorne | 165/133 |
| 4,159,739 A | | 7/1979 | Brothers et al. | 165/133 |
| 4,166,498 A | * | 9/1979 | Fujie et al. | 165/133 |
| 4,179,911 A | | 12/1979 | Saier et al. | 72/78 |
| 4,195,688 A | * | 4/1980 | Fujie et al. | 165/184 X |
| 4,232,735 A | * | 11/1980 | Kim et al. | 165/184 X |
| 4,353,234 A | | 10/1982 | Brothers et al. | 72/98 |
| 4,425,696 A | | 1/1984 | Torniainen | 29/157 |
| 4,438,807 A | | 3/1984 | Mathur et al. | 165/133 |
| 4,679,423 A | | 7/1987 | Ballentine | 73/37 |
| 4,690,211 A | | 9/1987 | Kuwahara et al. | 165/177 |
| 4,692,978 A | | 9/1987 | Cunningham et al. | 29/157 |
| 4,715,436 A | | 12/1987 | Takahashi et al. | 165/133 |
| 4,765,058 A | | 8/1988 | Zohler | 29/727 |
| 4,866,830 A | | 9/1989 | Zohler | 29/157 |
| 5,054,548 A | | 10/1991 | Zohler | 165/133 |
| 5,070,937 A | | 12/1991 | Mougin et al. | 165/133 |
| 5,146,979 A | | 9/1992 | Zohler | 165/133 |
| 5,222,299 A | | 6/1993 | Zohler | 29/890 |
| 5,333,682 A | * | 8/1994 | Liu et al. | 165/184 X |
| 5,597,039 A | | 1/1997 | Rieger | 165/133 |

FOREIGN PATENT DOCUMENTS

| | | | | |
|---|---|---|---|---|
| JP | 0016766 | * | 7/1979 | 165/133 |
| JP | 0018327 | * | 9/1981 | 165/133 |
| JP | 0029997 | * | 2/1984 | 165/133 |
| JP | 0035394 | * | 3/1985 | 165/133 |
| JP | 0291895 | * | 12/1986 | 165/133 |
| JP | 0087036 | * | 3/1989 | 165/133 |
| JP | 00172892 | * | 7/1989 | 165/133 |

* cited by examiner

*Primary Examiner*—Christopher Atkinson
(74) *Attorney, Agent, or Firm*—William J. Beres; William O'Driscoll

(57) ABSTRACT

The present invention provides an improved heat transfer surface. The improved heat transfer comprises: a surface covered with fin convolutions. The fin convolutions have fin tips extending from the surface. The fin tips have a first plurality of notches and a second plurality of notches wherein the first notches and the second notches are of different sizes.

2 Claims, 3 Drawing Sheets

FIG. 1
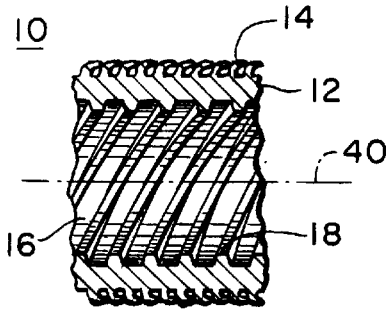
FIG 3
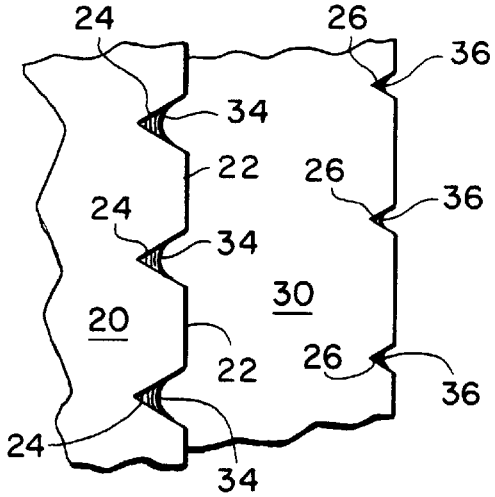
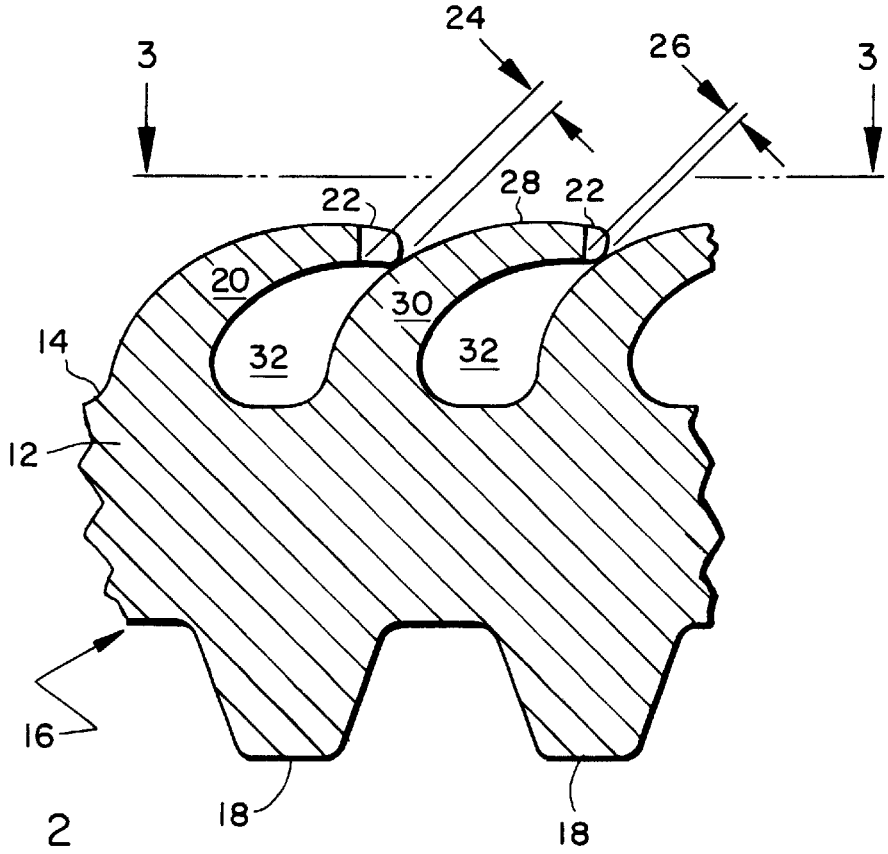
FIG. 2

NUCLEATE BOILING SURFACE

BACKGROUND OF THE INVENTION

The present invention is directed to an improved nucleate boiling heat transfer surface. In the preferred embodiment, the surface is formed as a heat transfer tube with water flowing through the inside of the heat transfer tube and refrigerant boiling on the outside of the heat transfer tube. More specifically, the present invention contemplates a heat transfer tube for application in the evaporator of a water chiller.

U.S. Pat. No. 3,881,342 to Thorne shows heat transfer tubing formed with generally circumferentially extending adjacent fin convolutions. The fin convolutions are provided with recesses in the outer edges and the fin convolutions are each bent uniformly towards the adjacent convolution to partly enclose the spaces between adjacent convolutions.

U.S. Pat. No. 3,768,290 to Zatell shows a similar arrangement where the fins are closely adjacent to the next adjacent fin convolution so as to provide small gaps of predetermined and controlled average size.

It is well known that there is an optimum recess size for a given refrigerant at a given heat flux. In an arrangement such as that of the Thorne patent, when the adjacent convolutions are rolled to the point of touching and when the recesses are all of the same size and are sized for maximum heat flux, the recesses will be too large at part load and the cavities beneath the rolled over fin convolutions will become flooded with liquid. This causes heat transfer performance to deteriorate.

SUMMARY OF THE INVENTION

It is an object, feature and advantage of the present invention to solve the problems in prior art externally enhanced heat transfer tubes and surfaces.

It is an object, feature and advantage of the present invention to provide a heat transfer surface having notched and rolled fin convolutions where the heat transfer performance is satisfactory at full and part load.

The present invention provides an improved heat transfer surface. The improved heat transfer comprises: a surface covered with fin convolutions. The fin convolutions have fin tips extending from the surface. The fin tips have a first plurality of notches and a second plurality of notches wherein the first notches and the second notches are of different sizes.

The present invention also provides a heat transfer tube for use in an evaporator tube or tube bundle. The tube includes an annular wall or base member having an inner surface, an outer surface and an elongate access. The tube has an inner rib on the inner surface of the annular wall, and a plurality of axially spaced fin convolutions on the outer surface of the annular wall. Sectors having precisely sized and designed indentations are located at specific intervals along an extreme outer edge of the axial spaced fin convolutions. Each of the precisely sized and designed indentations on an individual fin has a different design depth or size than an immediately adjacent indentation. Each fin convolution is bent over so that a tip of each fin convolution is brought into contact or overlapped contact to a side of an adjacent fin convolution and defines an elongated circumferential tunnel or enclosed cavity. Each bent over fin convolution is of curvilinear cross-section over substantially its entire length starting from a skewed plane normal to an elongate tube axis. Each of the indentations on the bent over fin convolution forming precisely, different shaped and sized pore openings communicating with the tunnel. The pore openings allowing a media or refrigerant to continuously fill and flow inside the tunnels whereby the heat exchanged through the inner surface, the base member and the fin convolutions will promote and sustain a nucleate boiling process in the media at a maximum efficiency over a wide range of heat fluxes.

The present invention further provides a method of making a heat exchanger tube. The method comprises the steps of: providing a tubular blank having a generally circular cross section of a predetermined outer diameter; forming an extended heat transfer surface by extruding a helical fin up from the outer surface of the tubular blank; applying lateral force to one side of the helix of the helical fin to cause the helical fin to bend over; and notching the side of the helix of the helical fin to form pores of at least two different sizes.

The present invention still further provides a method of making a heat exchanger tube. The method comprises the steps of: providing a tubular blank having a generally circular cross section of a predetermined outer diameter; forming an extended heat transfer surface by extruding a helical fin up from the outer surface of the tubular blank; notching the side of the helix of the helical fin to form pores of at least two different sizes; and applying lateral force to one side of the helix of the helical fin to cause the helical fin to bend over.

The present invention yet further provides a method of providing a heat exchanger tube having continuous helical fins thereon with a plurality of first and second size cavities in the periphery of the fin. The method comprises the steps of: deforming the periphery of the fins to less than the full depth thereof to form a first size cavity thereon; deforming the periphery of the fins to less than the full depth thereof to form a second sized cavity thereon wherein the second size cavity is of different size than the first size cavity; and rolling the tips of the helical fins to touch the side of the adjacent helical fin.

BRIEF DESCRIPTION OF THE DRAWINGS

FIG. 1 shows a heat transfer tube to which the present invention is applicable.

FIG. 2 shows a heat transfer tube including rolled fin convolutions touching the next adjacent fin convolution and being notched in accordance with the present invention.

FIG. 3 shows a fin notching arrangement for two adjacent fin convolutions in accordance with the present invention.

FIG. 7A shows a triangular notch shape, FIG. 7B shows a rectangular notch shape, FIG. 7C shows a generally circular notch shape and FIG. 7D shows a half hexagon or truncated triangle shape.

DETAILED DESCRIPTION OF THE DRAWINGS

Figure 4:
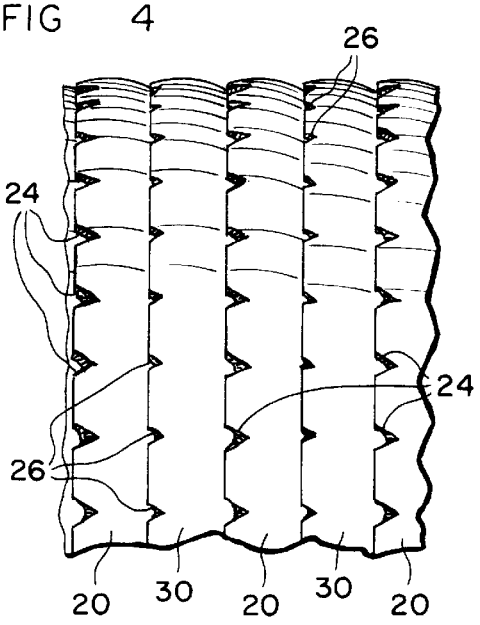
FIG. 4 shows the arrangement of FIG. 3 on a portion of a heat transfer tube.

FIG. 1 shows a portion of a heat transfer tube 10 including a tube wall 12, an external tube surface 14 and an internal tube surface 16. The internal surface 16 may be plain or may be internally enhanced. For example, an internally enhanced surface includes the surface shown in applicant's commonly assigned U.S. Pat. No. 5,070,937 to Mougin et al., the disclosure of which is hereby incorporated by reference. Applicant hereby also incorporates by reference U.S. Pat. No. 5,597,039 to Rieger.

The present invention is directed to enhancements to the external tube surface 14. While this tube surface 14 is preferably an integral part of a heat transfer tube 10, it should be recognized that the improved, externally enhanced surface is applicable to other heat transfer surfaces such as nonrolled, flat surfaces.

FIG. 2 shows a portion of the tube wall 12 of FIG. 1 including internal enhancements 18 on the internal surface 16 and external enhancements 20 on the external surface 14. These external enhancements 20 are preferably in the form of a helical fin convolution having a distal tip 22 which is notched 24, 26. The tip 22 of each fin convolution 20 is rolled such that the tip 22 touches an external side 28 of the next adjacent fin convolution 30 so as to form a tunnel or cavity 32 between adjacent fin convolutions 20, 30. The plurality of tunnels 32 and the plurality of fin convolutions 20 spiral helically around the external surface 14 of the heat transfer tube 10. Such surfaces are known as shown by U.S. Pat. No. 3,683,656 to Lewis; U.S. Pat. No. 3,768,290 to Zatell and U.S. Pat. No. 3,881,342 to Thorne, the general disclosures of which are incorporated by reference.

The present invention differs from the previous arrangement in that the notches on the fin tips 22 are of varying sizes. In the preferred embodiment there are two sizes, a large notch 24 on one fin convolution 20 and a small notch 26 on the adjacent fin convolutions 30. When the fin tips 22 touch and engage the external surface 28 of the adjacent fin convolution 30, the large notches 24 form large pores 34, while the small notches 26 form small pores 36. The different pore sizes 34, 36 provide different performance under full and part load conditions.

In the preferred embodiment shown in FIG. 3, the fin convolutions 20, 30 alternate, with the fin convolutions 20 having the large notches 24 and the fin convolutions 30 having the small notches 26. This results in the alternating arrangement shown in FIG. 4.

Figure 5:
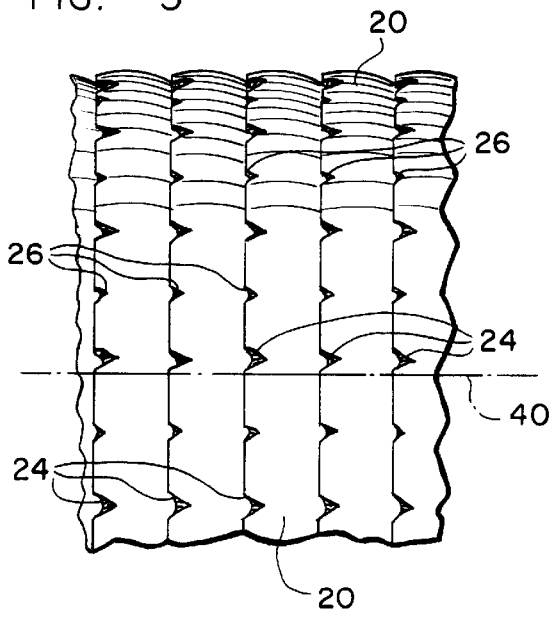
FIG. 5 shows an alternative embodiment of the present invention having a fin notching arrangement in accordance with the present invention.

FIG. 5 shows a first alternative embodiment where the large and small notches 24, 26 alternate on the same fin convolution 20. In FIG. 5, the large and small notches 24, 26 alternate radially but are linearly arranged when viewed in a line parallel to the tube access 40.

Figure 6:
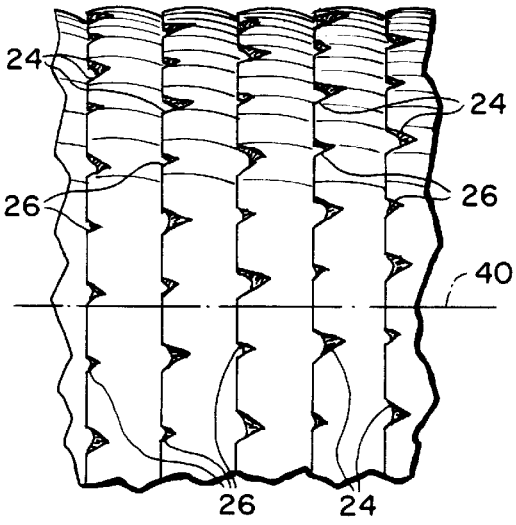
FIG. 6 shows a further alternative embodiment of the present invention having notched fin convolutions in accordance with the present invention.

FIG. 6 shows a further alternative embodiment, similar to FIG. 5 in that the large and small notches 24, 26 alternate on the same fin convolution 20, but where the large and small notches 24, 26 are staggered when viewed along a line parallel to the tube access 40.

Figure 7A:
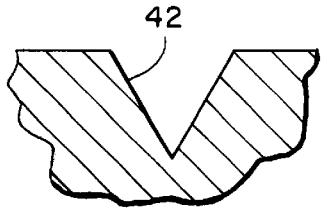
FIGS. 7A–C show several contemplated notch shapes in accordance with the present invention.
Figure 7B:
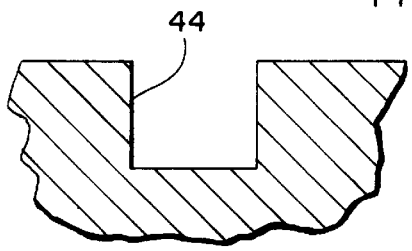
Figure 7C:
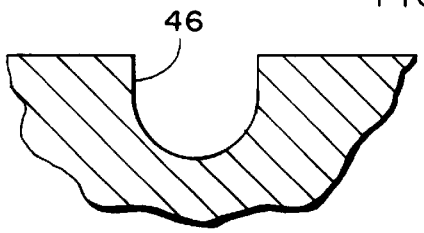
Figure 7D:
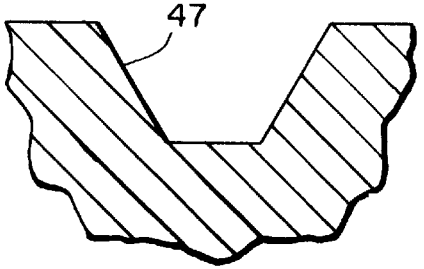

The notches 24, 26 are preferably formed in a triangular shape 42 such as is shown by FIG. 7A or in a truncated triangle shape as shown in FIG. 7D. Other notch shapes are contemplated including the rectangular shape 44 shown in FIG. 7B, the circular shape 46 shown in FIG. 7C, and the half hexagon or truncated triangle shape 47 shown in FIG. 7D. Other more complex shapes are contemplated including, for example, hexagonal shapes. The more complex shapes are not preferred due to the added manufacturing difficulties involved. The present invention also contemplates that various arrangements of shaped notches and sizes could be used. Small notches 26 of triangular shape such as shown in FIG. 7A can alternate with large notches 24 of rectangular shape such as shown in FIG. 7B.

Many methods of rolling and notching heat exchanger tubing are known including those evidenced by the previously incorporated by reference patents as well as by U.S. Pat. No. 3,487,670 to Ware; U.S. Pat. No. 3,648,502 to Klug et al. and U.S. Pat. No. 5,222,299 to Zohler, the disclosures of which are also incorporated by reference.

Figure 8:
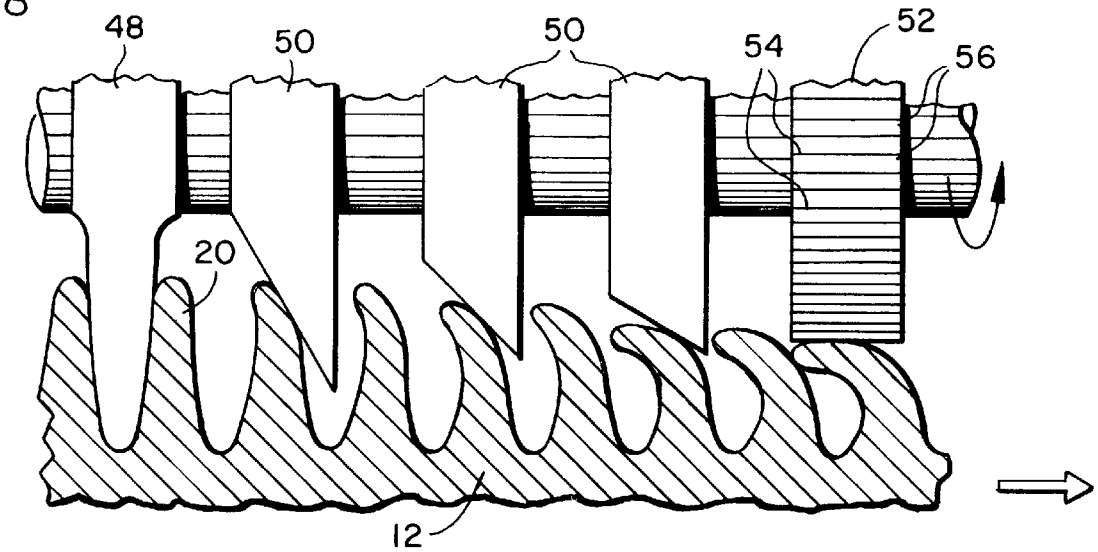
FIG. 8 shows a fin die arrangement for manufacturing the present invention.

FIG. 8 shows one fin die arrangement for forming the notched heat exchanger tube of the present invention. The arrangement of FIG. 8 includes a forming disc 48 and various roller discs 50 to smooth over and tip the fin convolutions. Also included is a first notching disc 52 where small linear protrusions 54 alternate with larger linear protrusions 56 and result in a notched surface like that shown in FIG. 5 or 6.

Figure 9:
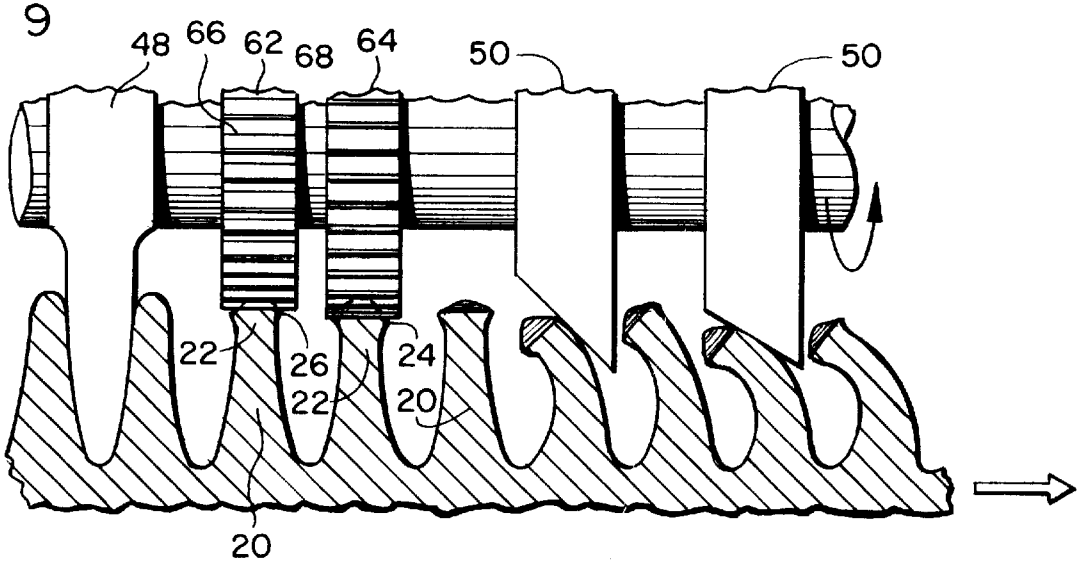
FIG. 9 shows an alternative fin die arrangement for manufacturing the present invention.

FIG. 9 shows an alternative embodiment fin die arrangement including a forming disc 48 and two notching discs 62, 64, followed by forming discs 50. Notching disc 62 includes small linear protrusions 56 for forming small notches 26 in the tips 22 of the fin convolutions 20. Notching disc 64 includes large linear protrusions 68 for forming large notches 24 in the tips 22 of the fin convolutions 20. This arrangement can result in fin surfaces like that shown in FIGS. 4, 5 or 6.

What has been shown is an arrangement for providing an internally enhanced heat transfer surface having rolled convolutions with a notched tip where the notches are of several sizes. Clearly a person of ordinary skill in the art will recognize that many modifications and alterations are contemplated by the present invention. Such modifications and alterations include the shape of the notches, the pattern of notch arrangement and the selection and spacing of the notches. Additionally, the present invention can be modified to flat, elliptical and other surfaces. All such modifications and alterations are contemplated to fall within the spirit and scope of the following claims.

What is claimed for Letters Patent of the United States is as follows:

1. An improved heat transfer surface comprising:

a surface covered with fin convolutions, the fin convolutions having fin tips extending from the surface, the fin tips having a first plurality of notches and a second plurality of notches wherein the first notches and the second notches are of different sizes;

wherein the first and second notches alternate.

2. The improved heat transfer surface of claim 1 wherein the first and second notches are of the same shape.

* * * * *